US012569717B1

(12) United States Patent
Nolan et al.

(10) Patent No.: US 12,569,717 B1
(45) Date of Patent: Mar. 10, 2026

(54) EXERCISE STAND FOR AN ATTACHMENT

(71) Applicant: Bulletproof Fitness Equipment Inc, Acton, CA (US)

(72) Inventors: Lawrence R Nolan, Santa Clarita, CA (US); Nolan K Nicole, Santa Clarita, CA (US); Christopher I Gaddy, Brooklyn, NY (US)

(73) Assignee: Bulletproof Fitness Equipment Inc, Acton, CA (US)

( * ) Notice: Subject to any disclaimer, the term of this patent is extended or adjusted under 35 U.S.C. 154(b) by 170 days.

(21) Appl. No.: 18/520,539

(22) Filed: Nov. 27, 2023

Related U.S. Application Data

(60) Provisional application No. 63/581,789, filed on Sep. 11, 2023, provisional application No. 63/428,316, filed on Nov. 28, 2022.

(51) Int. Cl.
*A63B 21/16* (2006.01)
*A63B 21/00* (2006.01)
*A63B 23/12* (2006.01)

(52) U.S. Cl.
CPC ..... *A63B 21/16* (2013.01); *A63B 21/4035* (2015.10); *A63B 23/1218* (2013.01); *A63B 23/1227* (2013.01); *A63B 2210/50* (2013.01)

(58) Field of Classification Search
CPC ..... A63B 71/023; A63B 1/00; A63B 69/22; A63B 2210/50; A63B 17/04
See application file for complete search history.

(56) References Cited

U.S. PATENT DOCUMENTS

| | | | | |
|---|---|---|---|---|
| 4,696,470 | A * | 9/1987 | Fenner | A63B 1/00 482/17 |
| 5,403,253 | A * | 4/1995 | Gaylord | A63B 69/0064 482/142 |
| 6,814,690 | B1 * | 11/2004 | Stearns | A63B 21/4047 482/52 |
| 9,295,866 | B2 * | 3/2016 | Kwo | A63B 71/023 |
| 9,713,741 | B1 * | 7/2017 | Tolliver | A63B 23/1227 |
| 10,987,532 | B2 * | 4/2021 | Lawton | A63B 23/03575 |
| 11,446,535 | B1 * | 9/2022 | Iverson | A63B 17/02 |
| 11,896,863 | B2 * | 2/2024 | Ivanov | A63B 69/34 |
| 12,251,597 | B2 * | 3/2025 | Castillo | A63B 21/4035 |
| 2009/0088303 | A1 * | 4/2009 | Footnick | A63B 21/00072 482/92 |
| 2011/0183823 | A1 * | 7/2011 | Priday | A63B 21/0783 482/131 |
| 2020/0101342 | A1 * | 4/2020 | Lawton | A63B 21/4033 |
| 2022/0379165 | A1 * | 12/2022 | Alfandre | A63B 21/00047 |
| 2023/0141103 | A1 * | 5/2023 | Christiansen | A61H 1/02 601/5 |

* cited by examiner

*Primary Examiner* — Andrew S Lo
(74) *Attorney, Agent, or Firm* — AVEK IP, LLC

(57) ABSTRACT

A stand configured to be couplable to an attachment member includes a pivotable leg and at least one support foot. The pivotable leg and the at least one support foot are each pivotably coupled to a hinge assembly. An exercise mode includes the pivotable leg pivoted rearward and the at least one support foot pivoted downward to support the pivotable leg in the exercise mode. A storage mode includes the pivotable leg pivoted forward and the at least one support foot pivoted upward.

16 Claims, 4 Drawing Sheets

EXERCISE STAND FOR AN ATTACHMENT

RELATED APPLICATIONS

This application claims priority to U.S. provisional application 63/428,316 filed Nov. 28, 2022, and also claims priority to U.S. provisional application 63/581,789 filed Sep. 11, 2023.

FIELD OF INVENTION

Embodiments of the invention relate generally to exercise equipment, and more specifically to a free-standing exercise stand configured for supporting a variety of removable attachments.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

The embodiments described herein relate to a stand configured for attaching an exercise attachment assembly thereto, the stand comprising a pivotable leg extending from a first end to a second end; a foldable support connected to the pivotable leg via a hinge assembly; the hinge assembly having a base support bracket connected to the pivotable leg such that the pivotable leg can rotate about a hinge axis and the base support bracket connected to the foldable support such that the foldable support is configurable from a storage position to a support position; and an extension leg attached to the pivotable leg and supporting the exercise attachment assembly via a connecting member. The exercise attachment assembly is held a distance above a ground surface via the pivotable leg and the extension leg.

According to another embodiment, the present disclosure relates to a combination of a stand and an exercise attachment assembly. The stand having a pivotable leg extending from a first end to a second end; a foldable support connected to the pivotable leg via a hinge assembly; the hinge assembly having a base support bracket connected to the pivotable leg such that the pivotable leg can rotate about a hinge axis and the base support bracket connected to the foldable support such that the foldable support is configurable from a storage position to a support position; and an extension leg attached to the pivotable leg and supporting the exercise attachment assembly via a connecting member. The exercise attachment assembly having an extension connected to the connecting member; and one or more handles attached to the extension. The exercise attachment assembly is removable from the extension leg via the connecting member; and the exercise attachment assembly is held a distance above a ground surface via the pivotable leg and the extension leg.

BRIEF DESCRIPTION OF THE DRAWINGS

Embodiments of the invention are described in detail below with reference to the attached drawings.

LIST OF REFERENCES

100—Stand
101—Exercise Attachment Assembly
102—Connecting Member
108—Pivotable Leg
109—First End
110—Hing Assembly
114—Second end
116—Extension Leg
118—insertable end
120—Apertures
124*a*—Opening
124*b*—Opening
130*a*—First locking member
130*b*—Second locking member
138—Hinge axis
150—Foldable support
150*a*—First foldable support foot
150*b*—Second foldable support foot
151—Mounting member
152—Base support bracket
153*a*—First sidewall
153*b*—Second sidewall
160—Tabs
161—Casters
163*a*—First foot member
163*b*—Second foot member
164*a*—First lateral member
164*b*—Second lateral member
166—Pivot axis
167—First aligned apertures
167*a*—Secondary auxiliary aperture
167*b*—Secondary auxiliary aperture
170—Protectors
200—Extension
204—Handle Mount
206—Arm
208—Dip Handle
210—Pull Up Handle
216—Reinfocement Handle
220—Forward Wall
222—Side Walls
400—Channel The drawings do not limit the invention to the specific embodiments disclosed and described herein. The drawings are not necessarily to scale, emphasis instead being placed upon clearly illustrating various principles of the disclosure.

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Exercise equipment is well known in the art and varies from complex machinery to simple devices, wherein a user may select various equipment based on their needs. In an embodiment of the invention disclosed herein, a stand 100 supports various attachments that are configured to be removably coupled to the stand 100 to provide a variety of exercise options. The stand 100 is compact and can be used in small spaces and foldable to facilitate portability and enable storage in limited spaces.

Figure 1:
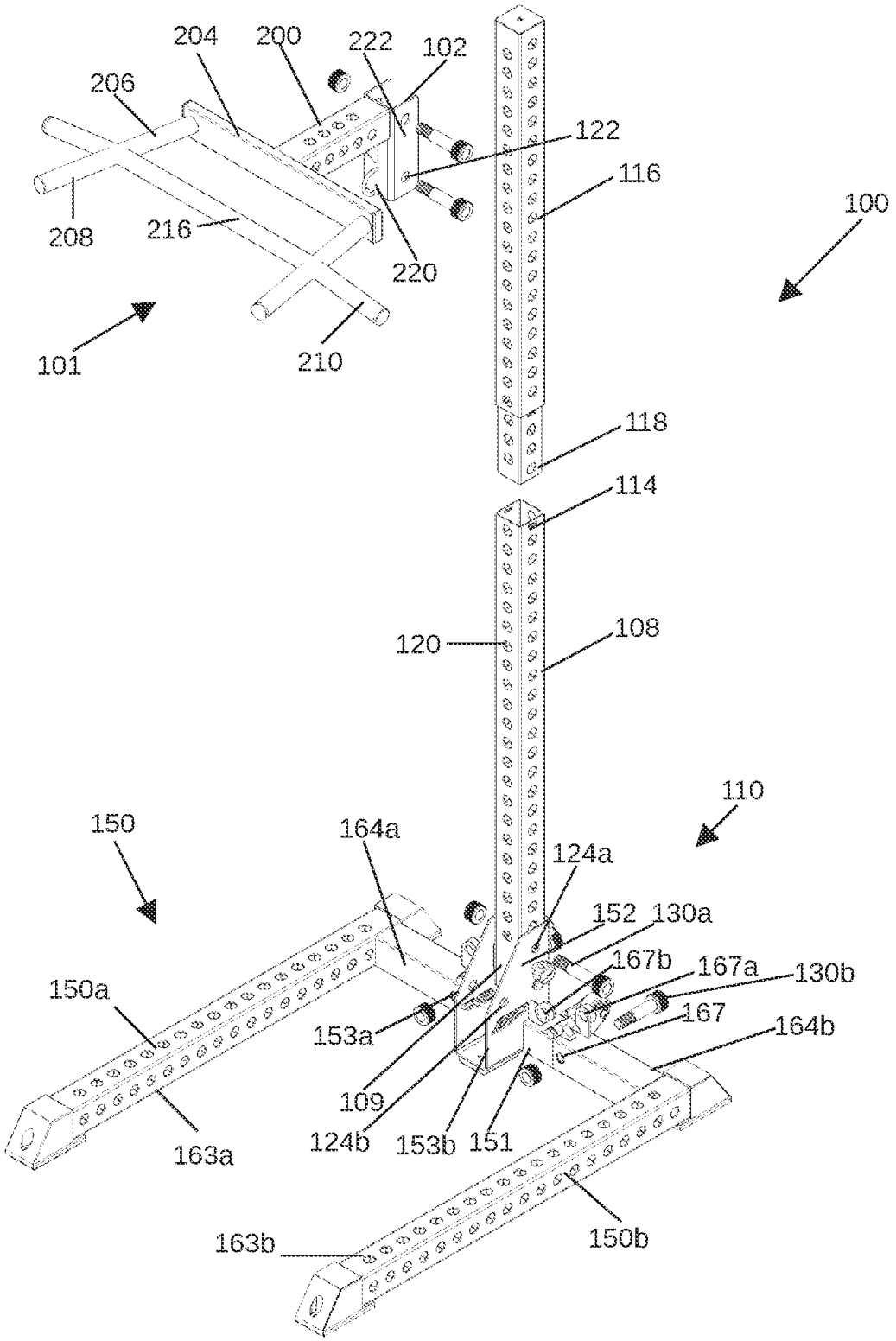
FIG. 1 is a front perspective view of an embodiment of an exercise stand with an exercise attachment assembly attached thereto and in a disassembled configuration in accordance with the present disclosure.
Figure 2:
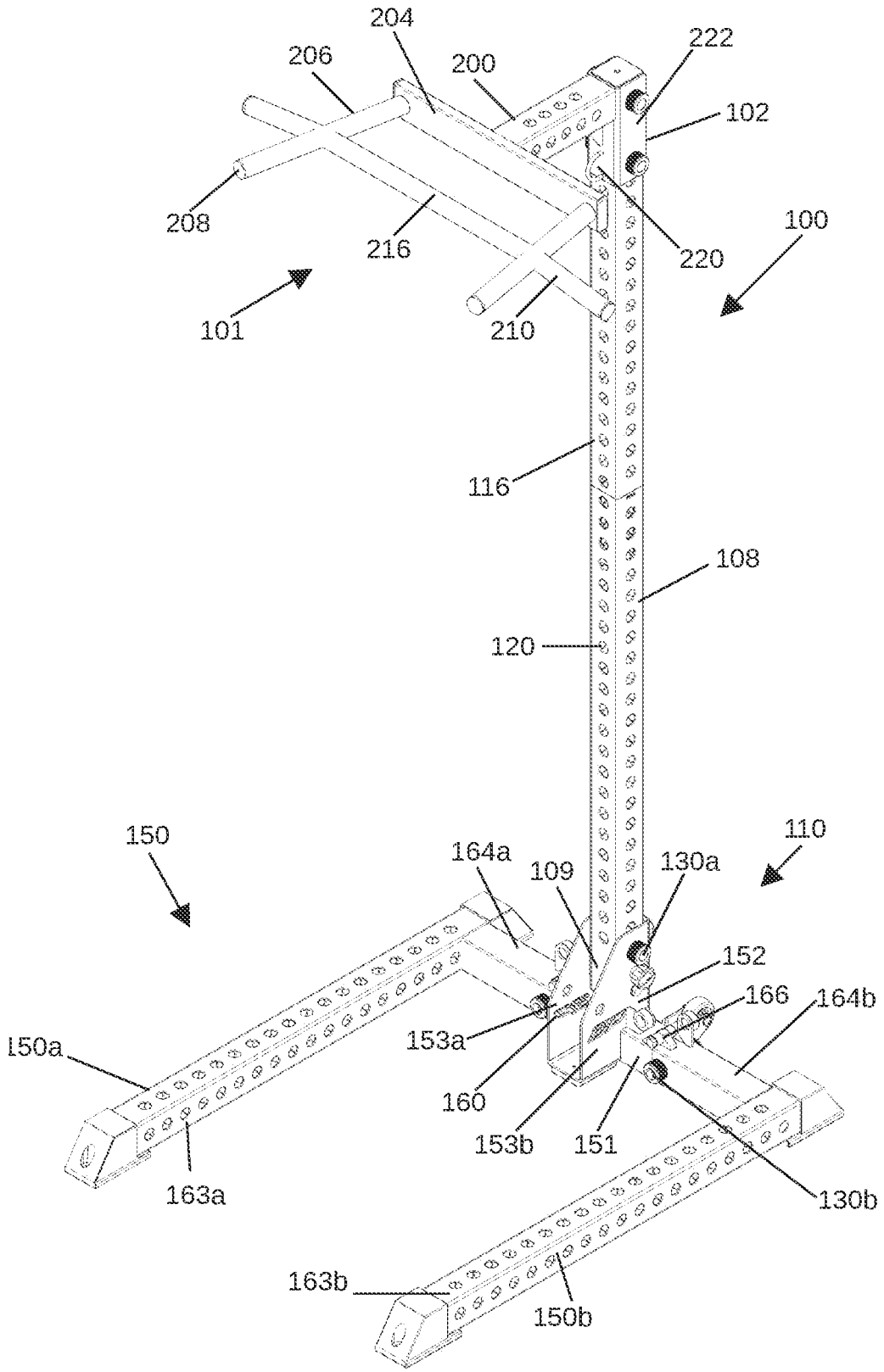
FIG. 2 is a front perspective view of the exercise stand and exercise attachment assembly of FIG. 1 in an assembled configuration.
Figure 3:
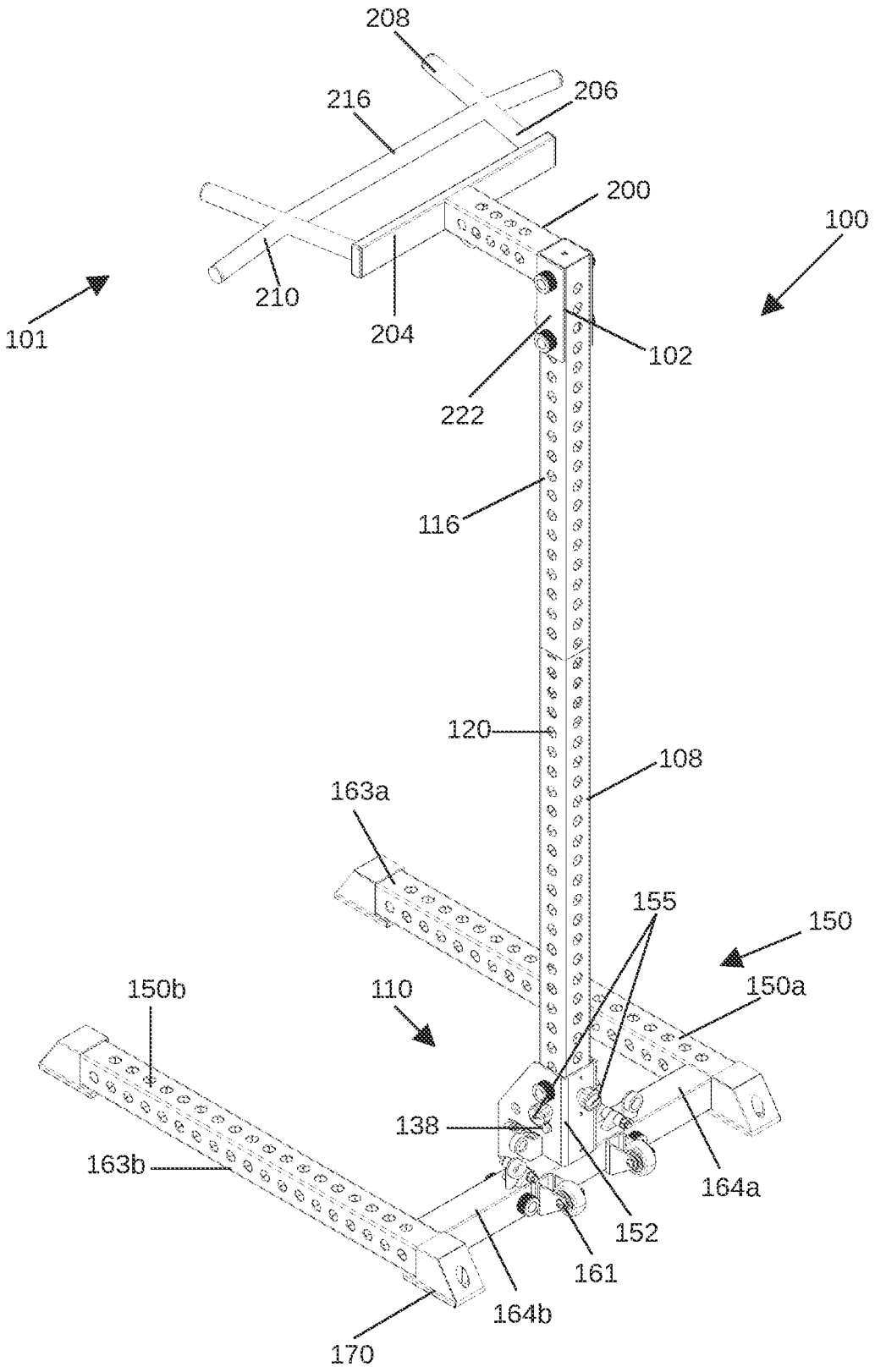
FIG. 3 is a rear perspective view of the exercise stand and exercise attachment assembly of FIG. 1 in an assembled configuration.
Figure 4:
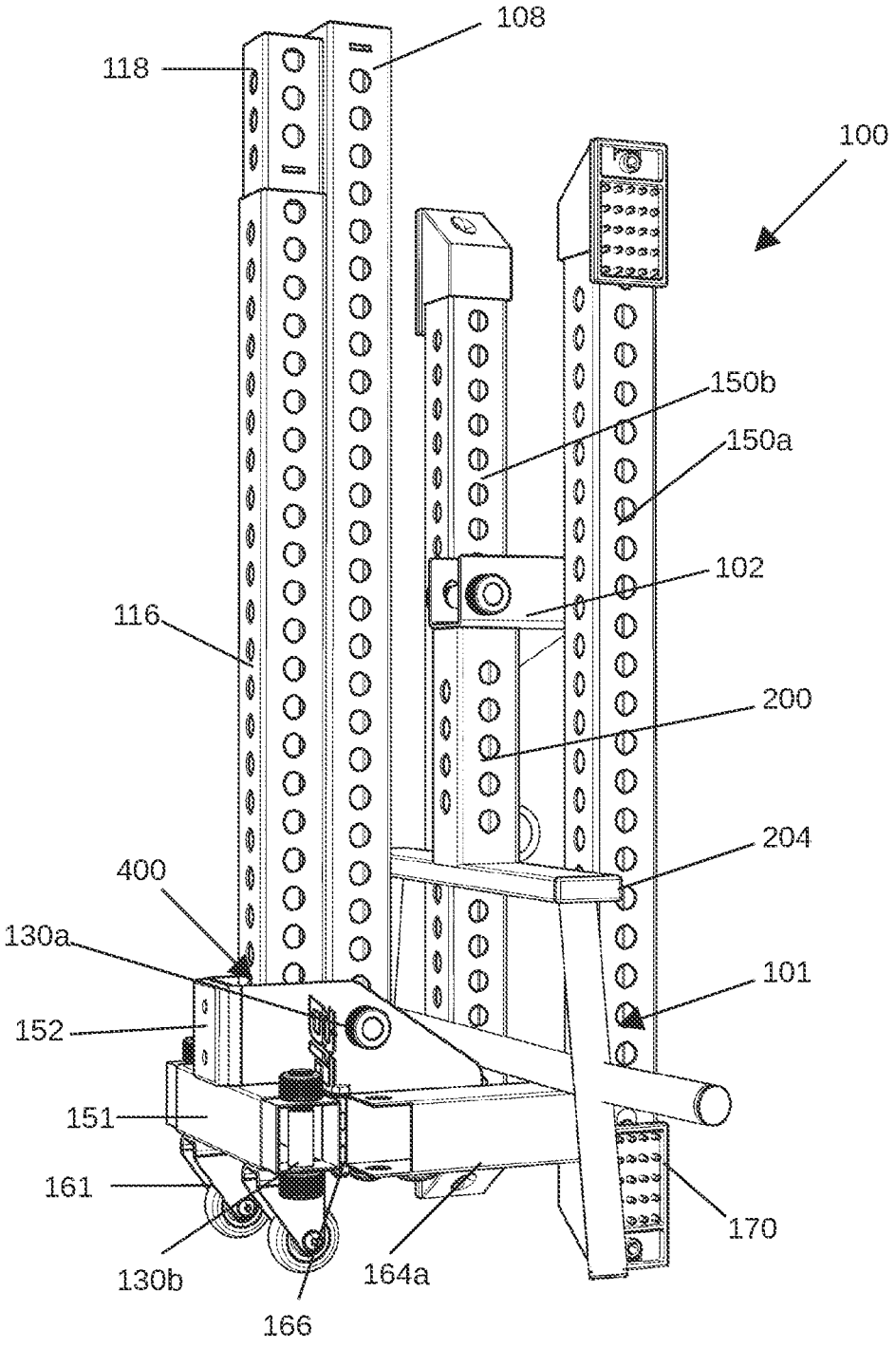
FIG. 4 is a perspective side view of the exercise stand and the exercise attachment assembly as shown in FIG. 1 in a storage mode, the exercise stand is in an upright position on castors and protectors, the exercise attachment assembly is uncoupled from the exercise stand and secured in a storage position, and the extension leg is uncoupled from a pivotable leg and positioned in a base support bracket.

FIG. 1 shows an embodiment of the stand 100 configured to be supported on a flooring/ground surface with one or more exercise attachment assemblies 101 coupled thereto, such as, for example, a pull-up/dip bar assembly or another assembly or accessory foreseeable by a person skilled in the art. Each attachment assembly 101 is configured to be secured to the stand 100 and includes a carriage or connecting member 102 for connecting the attachment assembly 101 to the stand 100. The stand 100 comprises a sleeve bracket or pivotable leg 108 having a first end 109 pivotably coupled to a hinge assembly 110 such that the pivotable leg 108 is pivotable into an upright or exercise mode as shown in FIGS. 1-3 or into a storage mode as shown in FIG. 4. In the exercise mode, the stand 100 is positioned for a user to perform an exercise using the attachment assembly 101 coupled thereto. In the storage mode, the stand 100 is folded compactly to facilitate moving the stand 100 and storing the stand 100. In the storage mode, the stand 100 is able to be easily transported and stored upright, minimizing a storage footprint of the stand 100.

The stand 100 is formed from a material or a combination of materials that is able to support a load, including the load of the attachment assembly 101 and the user, and any other forces that may be exerted on the stand 100 as a result of use of the attachment assembly 101 supported thereon. In a preferred embodiment, the stand 100 is formed from a steel construction. The unit is also designed to support loads isolated to the pivotable leg 108 and can be used without the extension leg 116 and attachment assemblies 101, specifically to support a leg isolator. Those skilled in the art will appreciate that the size and dimensions of the components may also vary.

The attachment assembly 101 is positionable at a desired height along extension leg 116 via the connecting member 102. A second end 114 of the pivotable leg 108 may slidably receive an extension leg 116 such that a user may position the attachment assembly 101 at a desired height along the extension leg 116, beyond the height of the pivotable leg 108. In other words, the extension leg 116 may not only vary in length, but also may be superfluous in some embodiments, and therefore not included. As shown in the embodiment of FIG. 1 showing an expanded/disassembled view of the stand 100, an insertable end 118 is coupled to or integral with the extension leg 116 and has an outer dimension approximately equal to an inner dimension of the extension leg 116. The insertable end 118 is secured or bolted to the extension leg 116 and configured to be received within the pivotable leg 108, securing the extension leg 116 to the pivotable leg 108 such that a diameter and cross-sectional shape of both legs 108 and 116 are consistent with one another and equivalent. In an embodiment, the insertable end 118 is secured to the pivotable leg 108 and an end of the extension leg 116 is configured to receive the insertable end 118. A locking member, such as a bolt, pin or threaded locking pin, may be used to secure the insertable end 118 to the extension leg 116 and/or the pivotable leg 108.

In a preferred embodiment, the pivotable leg 108 and the extension leg 116, including the insertable end 118, are formed from square posts having a plurality of apertures 120. The square-shaped post of the pivotable leg 108 prevents the insertable end 118 of the extension leg 116 from rotating relative to the pivotable leg 108 and prevents the pivotable leg 108 from rotating in the hinge assembly 110. The square posts of the pivotable leg 108 and the extension leg 116 prevent the connecting member 102 of the attachment assembly 101 from rotating relative to the leg 108 or 116. It is foreseeable that the pivotable leg 108 and the extension leg 116 may be formed from posts of another polygonal shape to form the stand 100.

The plurality of apertures 120 are aligned vertically on each face of the pivotable leg 108 and the extension leg 116. Each of the plurality of apertures 120 on each face is positioned opposite an aperture 120 on an opposite face such that a pin or bolt can be inserted therethrough for locking the leg 108 or 116 to another component. The plurality of apertures 120 are alignable with openings 122 on the connecting member 102 of the attachment assembly 101 for securing the leg 108 or 116 to the attachment assembly 101. The apertures 120 also align with openings **124*a* and 124*b* on the hinge assembly 110 for securing the pivotable leg 108 to the hinge assembly 110 and the extension leg 116 to the hinge assembly in the storage mode as shown in FIG. 4. Locking member 130*a* extends through and secures the pivotable leg 108 to the hinge assembly as shown in FIG. 2. In a preferred embodiment, the locking member 130*s* is a threaded locking pin configured such that a user is able to secure components together by hand. The threaded locking member 130*a*, as well as similar locking members (i.e. locking member 130*b*) is used for securing various components of the stand 100 together to eliminate a need for tools in converting the stand 100** between the exercise mode and the storage mode.

The first end 109 of the pivotable leg 108 is pivotably connected to the hinge assembly 110. The pivotable leg 108 rotates about a hinge axis 138 having an axis extending through the hinge assembly 110 parallel to the floor. Removal of the locking member **130*a* from allows a user to selectively pivot the pivotable leg 108 forward approximately 90° from the exercise mode to the storage mode and/or rearward approximately 90° from the storage mode to the exercise mode. As shown in FIG. 3, the openings 124*a* are configured for securing the pivotable leg 108 in the exercise mode and the openings 124*b* are configured for securing the pivotable leg 108 in the storage mode. The openings 124*a* are alignable with at least one of the plurality of apertures 120 and the locking member 130*s* is securable therein to secure the pivotable leg 108 in the exercise mode. The openings 124*b* are alignable with at least one of the plurality of apertures 120 and the locking member 130*a* is securable therein to secure the pivotable leg 108** in the storage mode.

As best shown in FIG. 4, the hinge assembly 110 comprises a mounting member 151 and a base support bracket 152 configured such that the pivotable leg 108 is pivotable therein between the exercise mode and the storage mode. The base support bracket 152 is mounted on the mounting member 151 and includes a first sidewall 153*a* extending parallel to a second sidewall 153*b* and forming an opening wherein the pivotable leg 108 is position. As also best shown in FIG. 4, a channel 400 is also created such that the removed extension leg 116 can rest and be secured therein when in the storage mode. In other words, the extension leg 116 can be removed from the pivotable leg 108 and then secured within the channel 400 for storage. The pivotable leg 108 is secured between the sidewalls 153*a* and 153*b*. The base support bracket 152 includes rubber pad clamps 155 that are screwable therein and that engage the pivotable leg 108 to provide added stability and support for the pivotable leg 108 in the exercise mode. An inner surface of each of the sidewalls 153*a* and 153*b* includes tabs 160 extending toward the opposite sidewall 153*a* and 153*b* such that the tabs 160 support the pivotable leg 108 in the storage mode. The mounting member 151 comprises casters 161 extending rearward of the stand 100 configured for rolling the stand 100 in the storage mode while a user supports the stand 100 in an upright or almost-upright position. In other words, as desired by a user, the stand 100 can be configured into the upright position shown in FIG. 4, for easy and convenient storage. During use, the user can use the casters 161 to move tilt the stand 100, then use the casters 161 to move the stand 100 to s desired location. Next, the user can use the casters 161 to tilt the stand 100 fully vertical and then rest the stand on the protectors 170 and the casters 161 to store the stand 100 in the folded and compact configuration shown in FIG. 4.

The hinge assembly 110 is pivotably coupled to a foldable support 150. In the embodiment shown in FIGS. 1-3, the hinge assembly 110 is pivotably coupled to a first foldable support foot 150*a* and a second foldable support foot 150*b* that form a support base or frame configured to be supported directly on the flooring when positioned in the exercise mode. The foldable support 150 is configured to prevent the load supported by the stand 100, including the load of the stand 100, the attachment assembly 101, and/or the user, from causing the stand 100 to fall in a direction, including forward, rearward, or to one of the sides.

Each foldable support foot 150 comprises a foot member 163*a-b* secured to a lateral member 164*a-b*. The foot member 163*a-b* is laterally spaced from the pivotable leg 108 by the lateral member 164*a-b*. The lateral member 164*a-b* is pivotably coupled to the mounting member 151 such that the lateral member 164 is rotatable upward 90° from the exercise mode to the storage mode and downward 90° from the storage mode to the exercise mode. The lateral member 164 is pivotable about a pivot axis 166 extending through the mounting member 151 having an axis extending parallel to the floor. In the embodiment shown, the pivot axis 166 extends approximately parallel to the foot member 163*b*. Each side of the foldable support 150 being identical or a mirror image of the other.

A surface of each foldable support foot 150*a-b* and a lower surface of the lateral member 164*a-b* support the stand 100 on the flooring in the exercise mode when the lateral member 164*a-b* is rotated downward such that each foot member 163*a-b* is substantially parallel to the floor. Each foldable support foot 150*a-b* includes first aligned apertures 167 for securing the foldable support foot 150*a-b* in the exercise mode with the locking member 130*b*. Secondary auxiliary apertures 167*a* and 167*b* are configured for securing each foldable support foot 150*a-b* in the storage mode with the locking member 130*b*. When the foldable support foot 150*a-b* is pivoted into the storage mode, the secondary auxiliary apertures 167*a*-167*b* are aligned and the locking member 130*b* will lock them in the folded position.

In the embodiments shown, each foot member 163*a-b* is formed from a post similar to that forming the pivotable leg 108 and the extension leg 116. Each foot member 163 includes a cap or protector 170 positioned at each end thereof to support the stand 100 on the floor. The protector 170 is configured to at least protect an end of the foot member 163*a-b*, protect the floor under the stand 100, and prevent the stand 100 from sliding or moving.

As best shown in FIGS. 1-3, the attachment assembly 101 is a pull-up/dip attachment assembly that is configured to be secured to the stand 100 such that a user is able to perform pull-up and/or dip exercises. This attachment assembly 101 includes an extension 200 secured between the connecting member 102 and a handle mount 204. The handle mount 204 is secured to a handle structure that comprises two arms 206 extending forward from the handle mount 204 and configured to space a dip handle 208 and a pull-up handle 210 coupled to each of the two arms 206 from the handle mount 204. The dip handles 208 extend forward from the arms and the pull-up handles 210 extend transverse to each of the two arms 206. A reinforcement handle 216 extends between the two arms 206, thereby connecting the two arms 206. The handles 208, 210, and 216 may be used for a variety of exercises. In embodiments, the attachment assembly 101 may include d-ring style anchors for suspension attachments as would be understood by those skilled in the art.

The connecting member 102 secured to the bracket 200 secures the attachment assembly 101 to the stand 100. The connecting member 102 comprises a forward wall 220 secured to the bracket 200, and two side walls 222 that each extend rearward from the forward wall 220 with the two side walls 222 each positionable on opposite sides of the pivotable leg 108 or extension leg 116. The two side walls 222 include the openings 122 that are alignable with the plurality of apertures 120 for positioning and securing the attachment assembly 101 to the stand 100. It is foreseeable that the connecting member 102 could be slidably engageable with the legs 108 and 116 for positioning of the attachment assembly 101 at a desired height.

In the embodiments shown in FIG. 1 and described herein, a forward or front side of the stand 100 is toward a left side of the drawing or between the first foldable support foot 150*a* and the second foldable support foot 150*b*, and a rear side of the stand 100 is toward a right side of the drawing or on an opposite side of the stand 100 as the first foldable support foot 150*a* and the second foldable support foot 150*b*. Likewise, upward is toward the top of the drawing or a top of the stand 100 and downward is toward the bottom of the drawing or a bottom of the stand 100.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. A stand configured for attaching an exercise attachment assembly thereto, the stand comprising:

a pivotable leg extending from a first end to a second end;

a foldable support connected to the pivotable leg via a hinge assembly;

the hinge assembly having a base support bracket having a first sidewall and a second sidewall, the pivotable leg secured between the first sidewall and the second sidewall such that the pivotable leg can rotate about a hinge axis and the base support bracket connected to the foldable support such that the foldable support is configurable from a storage position to a support position; and an extension leg attached to the pivotable leg and supporting the exercise attachment assembly via a connecting member;

wherein the exercise attachment assembly is held a distance above a ground surface via the pivotable leg and the extension leg.

2. The stand of claim 1, wherein the first sidewall and the second sidewall form a channel the channel configured to receive the extension leg when the foldable support is in the storage position.

3. The stand of claim 2, wherein when in the storage position the extension leg and the pivotable leg extend in a direction away from the base support bracket and are positioned adjacent to one another.

4. The stand of claim 1, wherein the hinge assembly further comprises a pivot axis connecting a first foldable support foot to the hinge assembly, wherein the pivot axis is configured to allow the first foldable support foot to pivot from a first position to a second position.

5. The stand of claim 1, wherein the foldable support further comprises:

a first foldable support foot having a first foot member connected to a first lateral member, the first lateral member pivotally connected to the hinge assembly; and a second foldable support foot having a second foot member connected to a second lateral member, the second lateral member pivotally connected to the hinge assembly.

6. The stand of claim 5, wherein the first foot member and the first lateral member are connected at a substantially right angle.

7. The stand of claim 5, wherein the foldable support further comprises one or more protectors configured to rest on the ground surface when the foldable support is in the storage position.

8. The stand of claim 1, wherein the pivotable leg and the extension leg are removably connected together via an insertable end of the pivotable leg.

9. A combination of a stand and an exercise attachment assembly, comprising:

the stand having:

a pivotable leg extending from a first end to a second end;

a foldable support connected to the pivotable leg via a hinge assembly;

the hinge assembly having a base support bracket having a first sidewall and a second sidewall, to the pivotable leg secured between the first sidewall and the second sidewall such that the pivotable leg can rotate about a hinge axis and the base support bracket connected to the foldable support such that the foldable support is configurable from a storage position to a support position; and an extension leg attached to the pivotable leg and supporting the exercise attachment assembly via a connecting member;

the exercise attachment assembly having:

an extension connected to the connecting member; and one or more handles attached to the extension;

wherein the exercise attachment assembly is removable from the extension leg via the connecting member; and wherein the exercise attachment assembly is held a distance above a ground surface via the pivotable leg and the extension leg.

10. The combination of claim 9, wherein the first sidewall and the second sidewall form a channel, the channel configured to receive the extension leg when the foldable support is in the storage position, and wherein when in the storage position the extension leg and the pivotable leg extend in a direction away from the base support bracket and are positioned adjacent to one another.

11. The combination of claim 9, wherein the hinge assembly further comprises a pivot axis connecting a first foldable support foot to the hinge assembly, wherein the pivot axis is configured to allow the first foldable support foot to pivot from a first position to a second position.

12. The combination of claim 9, wherein the foldable support further comprises:

a first foldable support foot having a first foot member connected to a first lateral member, the first lateral member pivotally connected to the hinge assembly; and a second foldable support foot having a second foot member connected to a second lateral member, the second lateral member pivotally connected to the hinge assembly.

13. The combination of claim 9, wherein the exercise attachment assembly further comprises:

a handle mount connected to the extension and extending out and away from the extension such that two substantially right angles are formed between the handle mount and the extension; and the one or more handles including a pair of dip handles and a pair of pull up handles.

14. A hinge assembly as part of a stand for receiving an exercise attachment assembly, the hinge assembly comprising:

a base support bracket having a first sidewall and a second sidewall forming an opening therebetween, the opening configured to receive a pivotable leg and secure the pivotable leg therein via a hinge axis;

a channel formed between the first sidewall and the second sidewall, the channel configured to receive an extension leg;

a mounting member extending from the base support bracket and having a first pivot axis configured to connect to a first lateral member and a second pivot axis configured to connect to a second lateral member;

a first auxiliary aperture extending from the base support bracket;

a second auxiliary aperture extending from the first lateral member, wherein the second auxiliary aperture is configured to align with the first auxiliary aperture when the first lateral member is pivoted into a storage position; and a first locking member configured to extend through the first auxiliary aperture and the second auxiliary aperture when the first and second auxiliary members are aligned;

wherein the hinge assembly is configured to allow the pivotable leg, the first lateral member, the second lateral member, and the extension leg to orient from a support position to the storage position.

15. The hinge assembly of claim 14, further comprising one or more caster wheels attached to the mounting member.

16. The hinge assembly of claim 14, further comprising one or more tabs extending into the opening between the first sidewall and the second sidewall.

* * * * *